US010863881B2

(12) United States Patent
Young

(10) Patent No.: US 10,863,881 B2
(45) Date of Patent: Dec. 15, 2020

(54) STAND-ALONE DISHWASHER

(71) Applicant: John Young, Louisville, KY (US)

(72) Inventor: John Young, Louisville, KY (US)

( * ) Notice: Subject to any disclaimer, the term of this patent is extended or adjusted under 35 U.S.C. 154(b) by 163 days.

(21) Appl. No.: 16/242,658

(22) Filed: Jan. 8, 2019

(65) Prior Publication Data

US 2020/0214533 A1 Jul. 9, 2020

(51) Int. Cl.
*A47L 15/42* (2006.01)
*A47L 15/50* (2006.01)

(52) U.S. Cl.
CPC ..... *A47L 15/4251* (2013.01); *A47L 15/4234* (2013.01); *A47L 15/4246* (2013.01); *A47L 15/4248* (2013.01); *A47L 15/4253* (2013.01); *A47L 15/4259* (2013.01); *A47L 15/4261* (2013.01); *A47L 15/4274* (2013.01); *A47L 15/4287* (2013.01); *A47L 15/506* (2013.01)

(58) Field of Classification Search
CPC ..... A47L 15/4251; A47L 15/4246; A47L 15/00–508
See application file for complete search history.

(56) References Cited

U.S. PATENT DOCUMENTS

| | | | | |
|---|---|---|---|---|
| 3,049,450 | A | 8/1962 | Koons | |
| 3,072,452 | A * | 1/1963 | Sleeper | A47L 15/06 312/228 |
| 3,092,134 | A * | 6/1963 | Allen | A47L 15/4263 137/355.17 |
| 3,794,400 | A * | 2/1974 | Guth | A47L 15/506 312/269 |
| 4,135,531 | A | 6/1979 | Federighi | |
| 4,366,005 | A | 12/1982 | Oguri | |
| 7,909,936 | B2 | 3/2011 | Lau | |
| 2011/0139181 | A1 | 6/2011 | Lee | |
| 2019/0283088 | A1 * | 9/2019 | Abdul-Ali | B08B 3/006 |
| 2020/0221919 | A1 * | 7/2020 | Lee | A47L 15/4221 |
| 2020/0221921 | A1 * | 7/2020 | Ham | A47L 15/4259 |

* cited by examiner

*Primary Examiner* — Spencer E Bell

(57) ABSTRACT

A stand-alone dishwasher for non-plumbed, environmentally friendly dishwashing includes a washer body. A front side has a drain aperture extending through to an inner compartment of the washer body. A lid is coupled to the washer body to cover and alternatively uncover a principal aperture. A plurality of rails is coupled within the inner compartment to support a plurality of racks that is removable through the principal aperture. A floor panel is coupled to the washer body and creates a lower compartment between a bottom side of washer body and the floor panel. A heater is coupled within the lower compartment. The heater is configured to turn water within the inner compartment into steam. A plurality of controls is coupled to the lid. The plurality of controls is in operational communication with the heating element.

11 Claims, 3 Drawing Sheets

STAND-ALONE DISHWASHER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dishwashers and more particularly pertains to a new dishwasher for non-plumbed, environmentally friendly dishwashing.

BRIEF SUMMARY OF THE INVENTION

An embodiment of the disclosure meets the needs presented above by generally comprising a washer body that has a front side separated from a rear side, a top side separated from a bottom side, and a left side separated from a right side. The front side, the rear side, the top side, the bottom side, the left side, and the right side form an inner compartment. The top side has a principal aperture extending through to the inner compartment. The front side has a drain aperture extending through to the inner compartment. The rear side has an access aperture extending through to the inner compartment. A lid is coupled to the washer body. The lid covers and alternatively uncovers the principal aperture. A drain is coupled to the washer body within the drain aperture. The drain has a valve. A plurality of rails is coupled to the washer body and is coupled to each of the front side and the rear side within the inner compartment. A plurality of racks is selectively engageable with the plurality of rails. The plurality of rails supports the plurality of racks within the inner compartment. The plurality of racks is removable through the principal aperture. A floor panel is coupled to the front side below the drain aperture, to the rear side above the access aperture, and extends from the left side to the right. The floor panel creates a lower compartment between the bottom side of washer body and the floor panel. A heater is coupled to the washer body within the lower compartment. The heater is configured to turn water within the inner compartment into steam. A plurality of controls is coupled to the lid. The plurality of controls is in operational communication with the heating element.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
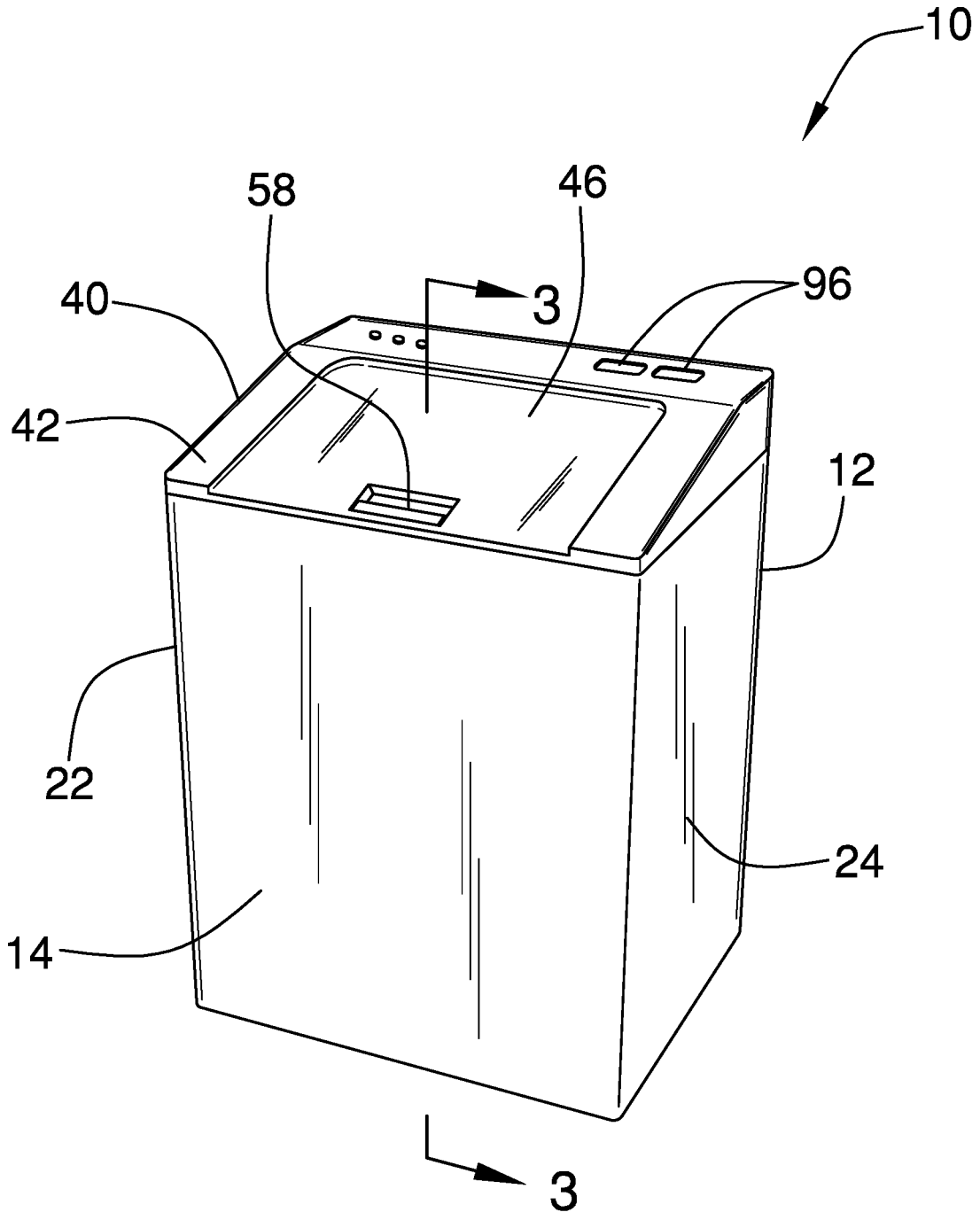
FIG. 1 is an isometric view of a stand-alone dishwasher according to an embodiment of the disclosure.
Figure 2:
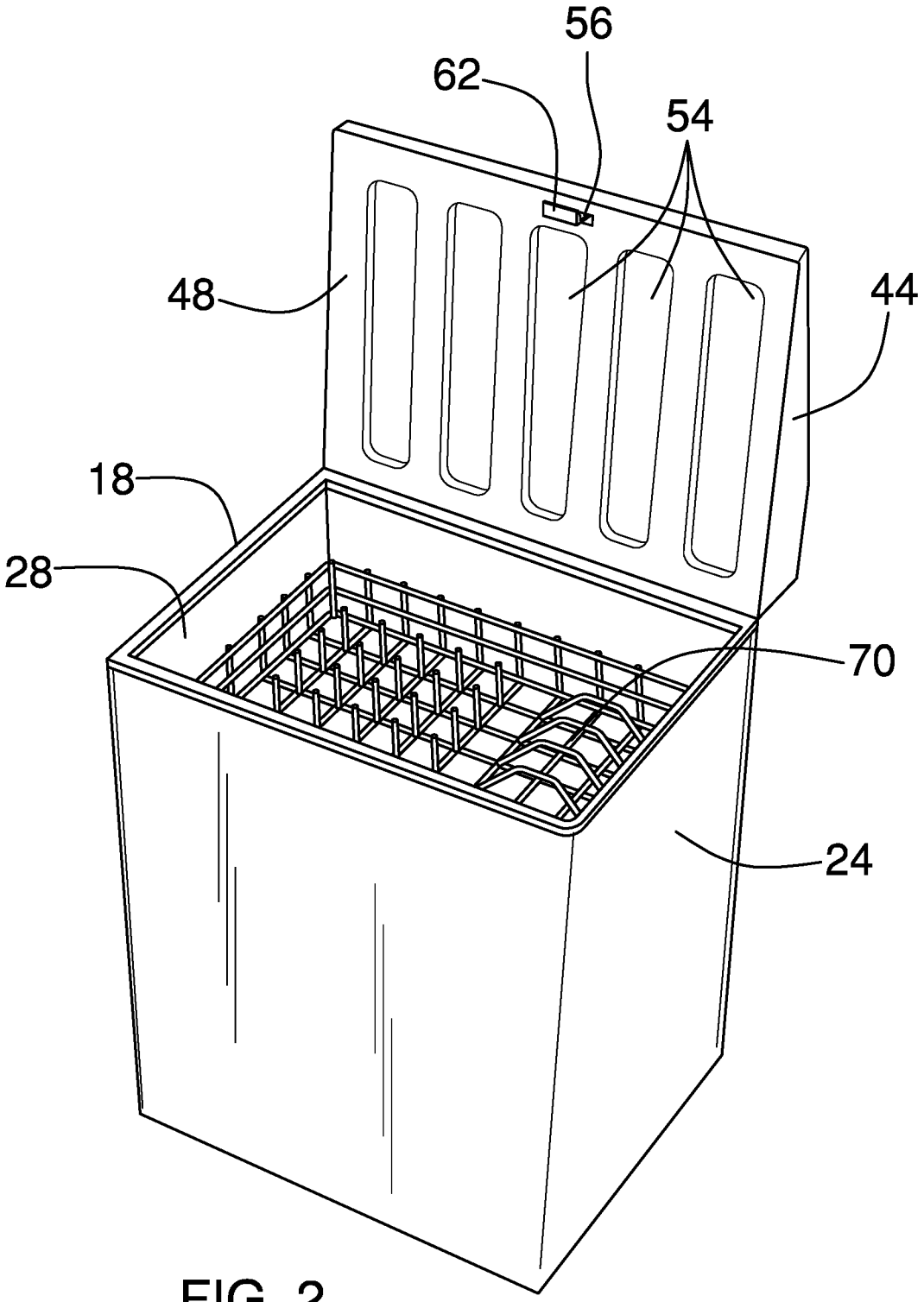
FIG. 2 is an isometric view of an embodiment of the disclosure.
Figure 3:
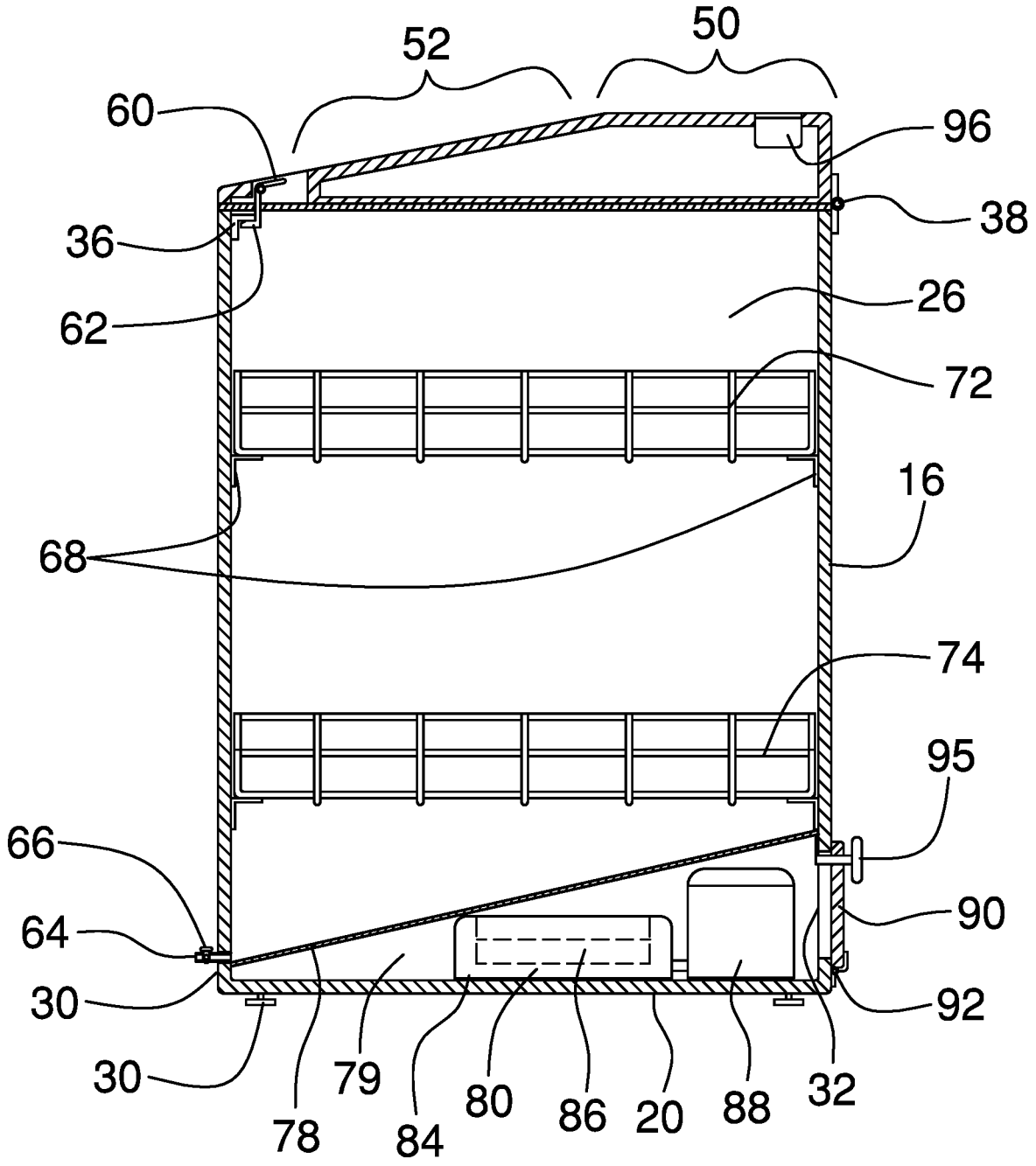
FIG. 3 is a cross-sectional view of an embodiment of the disclosure along line 3-3 of FIG. 1.

With reference now to the drawings, and in particular to FIGS. 1 through 3 thereof, a new dishwasher embodying the principles and concepts of an embodiment of the disclosure and generally designated by the reference numeral 10 will be described.

As best illustrated in FIGS. 1 through 3, the stand-alone dishwasher 10 generally comprises a washer body 12 having a front side 14 separated from a rear side 16, a top side 18 separated from a bottom side 20, and a left side 22 separated from a right side 24. The front side 14, the rear side 16, the top side 18, the bottom side 20, the left side 22, and the right side 24 form an inner compartment 26. The top side 18 has a principal aperture 28 extending through to the inner compartment 26. The front side 14 has a drain aperture 30 extending through to the inner compartment 26, and the rear side 16 has an access aperture 32 extending through to the inner compartment 26. A plurality of feet 34 is coupled to the bottom side 20 of the washer body. A catch 36 is coupled to the front side 14 within the inner compartment 26 of the washer body 12. A lid hinge 38 is coupled to the rear side 16 of the washer body 12 proximal the top side 18. A lid 40 is coupled to the lid hinge 38. The lid 40 swings from a closed position 42 covering the principal aperture 28 to an alternate open position 44 uncovering the principal aperture 28. The lid has an upper side 46 and a lower side 48 and may be right trapezoidal. The upper side 46 has a parallel portion 50 and an angled portion 52, and the lower side 48 of the lid has a plurality of indentations 54. The upper side 46 has a latch aperture 56 extending through the angled portion 52 to the lower side 48. A latch 58 is coupled to the lid 40 within the latch aperture 56. The latch 58 has a handle 60 and a tongue 62. The tongue 62 is selectively engageable with the catch 36 to secure the lid in the closed position 42. A drain 64 is coupled to the washer body 12 within the drain aperture 30. The drain has a valve 66. A plurality of rails 68 is coupled to the washer body 12. The plurality of rails 68 is coupled to each of the front side 14 and the rear side 16 within the inner compartment 26. A plurality of racks 70 is selectively engageable with the plurality of rails 68. The plurality of rails 68 supports the plurality of racks 70 within the inner compartment 26. The plurality of racks 70 is removable through the principal aperture 28. The plurality of racks 70 may comprise an upper rack 72 and a lower rack 74, and each of the upper rack 72 and the lower rack 74 are configured to secure a plurality of dishes. A floor panel 78 is coupled to the washer body 12. The floor panel 78 is coupled to the front side 14 below the drain aperture 30, to the rear side 16 above the access aperture 32 and extends from the left side 22 to the right side 24. The floor panel 78 creates a lower compartment 79 between the bottom side 20 of washer body 12 and the floor panel 78. The floor panel 78 may be angled to funnel water towards the drain 64. A heater 80 is coupled to the washer body 12 within the lower compartment 80. The heater 80 is configured to turn water within the inner compartment 26 into steam. The heater 80 is one of an electric heater or a propane heater 84. The propane heater 84 comprises a heating element 86 and a refillable propane tank 88. An access door 90 is coupled to the rear side 16 to cover and alternatively uncover the access aperture 32. The access door 90 has an access hinge 92 and an access handle 94. The access hinge 92 is coupled to the rear side 16 allowing the access door 90 to swing open. The access door 90 provides access to the lower compartment 79. A plurality of controls 96 is coupled to the lid 40 within the parallel portion 50. The plurality of controls 96 is in operational communication with the heating element 86.

In use, the plurality of dishes, water, and a cleaning agent are placed in the inner compartment 26 of the washer body 12 and the plurality of controls 96 is engaged to activate the heater 80 and turn the water into steam to clean the plurality of dishes 76.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stand-alone dishwasher comprising:

a washer body, the washer body having a front side separated from a rear side, a top side separated from a bottom side, and a left side separated from a right side, the front side, the rear side, the top side, the bottom side, the left side, and the right side forming an inner compartment, the top side having a principal aperture extending through to the inner compartment, the front side having a drain aperture extending through to the inner compartment, and the rear side having an access aperture extending through to the inner compartment;

a lid coupled to the washer body, the lid covering and alternatively uncovering the principal aperture;

a drain coupled to the washer body, the drain being coupled within the drain aperture, the drain having a valve;

a plurality of rails coupled to the washer body, the plurality of rails being coupled to each of the front side and the rear side within the inner compartment;

a plurality of racks, the plurality of racks being selectively engageable with the plurality of rails, the plurality of rails supporting the plurality of racks within the inner compartment, the plurality of racks being removable through the principal aperture;

a floor panel coupled to the washer body, the floor panel being coupled to the front side below the drain aperture, to the rear side above the access aperture, and extending from the left side to the right, the floor panel creating a lower compartment between the bottom side of washer body and the floor panel;

a heater coupled to the washer body, the heater being coupled within the lower compartment, the heater being configured to turn water within the inner compartment into steam;

a plurality of controls coupled to the lid, the plurality of controls being in operational communication with the heating element.

2. The stand-alone dishwasher of claim 1 further comprising the floor panel being angled, the floor panel funneling water towards the drain.

3. The stand-alone dishwasher of claim 1 further comprising a lid hinge coupled to each of the washer body and the lid, the lid hinge being coupled to the rear side of the washer body proximal the top side, the lid swinging on the lid hinge from a closed position covering the principal aperture to an alternate open position uncovering the principal aperture.

4. The stand-alone dishwasher of claim 3 further comprising the lid having an upper side and a lower side, the upper side having a latch aperture extending through to the lower side, a latch being coupled within the latch aperture, the latch having a handle and a tongue, the tongue being selectively engageable with a catch coupled to the front side of the washer body within the inner compartment.

5. The stand-alone dishwasher of claim 4 further comprising the lid being right trapezoidal, the upper side having a parallel portion and an angled portion, the plurality of controls being coupled within the parallel portion and the latch aperture extending through the angled portion, the lower side of the lid having a plurality of indentations.

6. The stand-alone dishwasher of claim 1 further comprising the heater being one of an electric heater or a propane heater, the propane heater comprising a heating element and a refillable propane tank.

7. The stand-alone dishwasher of claim 6 further comprising an access door coupled to the washer body, the access door being coupled to the rear side to cover and alternatively uncover the access aperture, the access door providing access to the lower compartment.

8. The stand-alone dishwasher of claim 7 further comprising the access door having an access hinge, the access hinge being coupled to the rear side allowing the access door to swing open, the access door having an access handle.

9. The stand-alone dishwasher of claim 1 further comprising a plurality of feet coupled to the washer body, the plurality of feet being coupled to the bottom side.

10. The stand-alone dishwasher of claim 1 further comprising the plurality of racks comprising an upper rack and a lower rack, each of the upper rack and the lower rack being configured to secure a plurality of dishes.

11. A stand-alone dishwasher comprising:

a washer body, the washer body having a front side separated from a rear side, a top side separated from a bottom side, and a left side separated from a right side, the front side, the rear side, the top side, the bottom side, the left side, and the right side forming an inner compartment, the top side having a principal aperture extending through to the inner compartment, the front side having a drain aperture extending through to the inner compartment, and the rear side having an access aperture extending through to the inner compartment;

a plurality of feet coupled to the washer body, the plurality of feet being coupled to the bottom side;

a catch coupled to the washer body, the catch being coupled to the front side within the inner compartment;

a lid hinge coupled to the washer body, the lid hinge being coupled to the rear side of the washer body proximal the top side, a lid coupled to the lid hinge, the lid swinging from a closed position covering the principal aperture to an alternate open position uncovering the principal aperture, the lid having an upper side and a lower side, the lid being right trapezoidal, the upper side having a parallel portion and an angled portion, the lower side of the lid having a plurality of indentations, the upper side having a latch aperture extending through the angled portion to the lower side;

a latch coupled to the lid, the latch being coupled within the latch aperture, the latch having a handle and a tongue, the tongue being selectively engageable with the catch to secure the lid in the closed position;

a drain coupled to the washer body, the drain being coupled within the drain aperture, the drain having a valve;

a plurality of rails coupled to the washer body, the plurality of rails being coupled to each of the front side and the rear side within the inner compartment;

a plurality of racks, the plurality of racks being selectively engageable with the plurality of rails, the plurality of rails supporting the plurality of racks within the inner compartment, the plurality of racks being removable through the principal aperture, the plurality of racks comprising an upper rack and a lower rack, each of the upper rack and the lower rack being configured to secure a plurality of dishes;

a floor panel coupled to the washer body, the floor panel being coupled to the front side below the drain aperture, to the rear side above the access aperture, and extending from the left side to the right, the floor panel creating a lower compartment between the bottom side of washer body and the floor panel, the floor panel being angled, the floor panel funneling water towards the drain;

a heater coupled to the washer body, the heater being coupled within the lower compartment, the heater being configured to turn water within the inner compartment into steam, the heater being one of an electric heater or a propane heater, the propane heater comprising a heating element and a refillable propane tank;

an access door coupled to the washer body, the access door being coupled to the rear side to cover and alternatively uncover the access aperture, the access door having an access hinge and an access handle, the access hinge being coupled to the rear side allowing the access door to swing open, the access door providing access to the lower compartment;

a plurality of controls coupled to the lid, the plurality of controls being coupled within the parallel portion, the plurality of controls being in operational communication with the heating element.

* * * * *